United States Patent [19]

Bennetot

[11] 4,385,588

[45] May 31, 1983

[54] ELECTRIFIABLE-MATERIAL APPLICATOR

[75] Inventor: Remy J. P. Bennetot, Pont Sainte-Marie, France

[73] Assignee: Societe Industrielle de Decoration et Application "Sida", Troyes, France

[21] Appl. No.: 210,538

[22] Filed: Nov. 26, 1980

[30] Foreign Application Priority Data

Nov. 28, 1979 [FR] France ..... 79 29718
Sep. 5, 1980 [FR] France ..... 80 19588

[51] Int. Cl.[3] ..... B05B 5/02

[52] U.S. Cl. ..... 118/638; 118/301; 118/624; 427/14.1; 427/26; 427/27; 427/200; 427/204

[58] Field of Search ..... 118/624, 638, 314, 621, 118/301, 640, 612; 427/14.1, 26, 200, 204, 27

[56] References Cited

U.S. PATENT DOCUMENTS 3,714,928 2/1973 Taylor ..... 427/26 X
3,793,050 2/1974 Mumpower ..... 427/14.1
3,798,048 3/1974 Brody et al. ..... 118/638 X

FOREIGN PATENT DOCUMENTS 2110493 10/1970 France .

*Primary Examiner*—Michael R. Lusignan
*Assistant Examiner*—Thurman K. Page
*Attorney, Agent, or Firm*—Karl F. Ross; Herbert Dubno

[57] ABSTRACT

A device for depositing an electrifiable material, e.g. cut strands, fleece, flock, upon an adhesive-coated surface comprises a vibrating sieve which is formed by a multiplicity of cylindrical parallel elements in line contact along respective generatrices and in line contact with an enclosure. In the interstices between these elements the electrifiable material passes through a grid on the bottom of this sieve which is connected to a high voltage source so that electrostatic forces assist in a transfer of the material to the adhesive. The application pattern is determined by a mask on the upper portion of the sieve and a complementary mask on a similar sieve through which excess particles are evacuated from the application region.

3 Claims, 7 Drawing Figures

ELECTRIFIABLE-MATERIAL APPLICATOR

FIELD OF THE INVENTION

My present invention relates to an apparatus for applying an electrifiable material, i.e. an electrically chargeable particulate substance such as chopped or cut fibers, fleece, flock and the like, to an adhesive-coated substrate in a particular pattern.

BACKGROUND OF THE INVENTION

It has already been proposed to apply particulate material capable of receiving an electrical charge, especially particulate solids and materials formed by chopping or cutting fibers, filaments or strands and even flocks, to adhesive-coated surfaces so that the applied material appears in relief and in accordance with a particular pattern upon the substrate.

In conventional systems of this type, the substrate is coated in accordance with the desired pattern with a layer of adhesive and the coated surface is disposed beneath a distributor for the electrifiable material. The latter can comprise a vibratory sieve which meters the electrifiable material onto the adhesive-coated surface and which can have a grill at its lower or discharge side which is connected to a terminal of a high voltage electrostatic field generator.

Because of the electrostatic field which is created, the material is generally drawn or directed perpendicular to the grill and to the receiving surface onto the adhesive coating and is implanted or bonded to the latter.

In practice, such sieves may be provided with partitions above the grill to define compartments for electrifiable materials of different colors whereby corresponding color patterns are generated on the adhesive layer in a single operation.

In all of these prior art systems it is necessary to remove excess electrifiable material from the substrate in regions in which this material has not been implanted in the adhesive zones. In practice the cleaning or particulate removal operation, because of the large quantities of material which must be removed is effected by mechanical means, generally a combination of aspiration (suction) and beating or agitation of the substrate.

While one can utilize, in addition or alternatively, an electrostatic system for picking up the excess by electrostatically charged surfaces, generally the electrostatic techniques are less effective. Hence even when electrostatic means are employed it is frequently necessary to complete the cleaning by aspiration and agitation.

In order to avoid damage to the applied pattern, it is customary to carry out the cleaning operations described above only after the implanted particles have been firmly bonded by adhesive to the substrate.

Thus a standard coating method comprises electrostatically applying the particles (i.e. the flock, cut fiber or the like) to a support previously coated with the adhesive, fixing the pattern particles in place by the adhesive to the support or substrate generally by a thermal treatment and agitating the support while drawing off excess particles by aspiration with or without electrostatic cleaning.

Such techniques have numerous disadvantages and primary among them is the dispersion of the particles which occurs upon deposition or removal. In general the dispersion is into the air around the coating and removal zones and the particles may contaminate the work space posing an environmental hazard to operating personnel, or contaminating other parts of the machinery or equipment used.

In the electrostatic application of the particles, the latter are distributed by means of a rectangular grill having an electrostatic charge which is imparted to the particles. When the particles reach or approach the adhesive layer or the substrate, they tend to reverse in polarity and are attracted back to the grill. As a result while there is a net movement of particles from the grill to the substrate, there is significant back and forth movement of particles in the space between the grill and the substrate.

At the center of the grill, where the lines of electrostatic force are substantially vertical and perpendicular to the parallel planes of the grill and the substrate, substantially all of the movement is in the vertical direction along the lines of force.

However, along the periphery of the grill the lines of the electromagnetic force bend outwardly as a result of the magnetic effect of large metal masses surrounding the space between the grill and the substrate and substantially invariable present in a normal workplace. Such neighboring equipment may include silk screen (screen printing or serigraphic equipment) or printing machinery for applying the adhesive or performing other decorative operations.

Because of the outward divergence of the magnetic lines of force, an outward dispersion of the particles can occur to contaminate the associated equipment.

Thus earlier arrangements for applying flock and other particle patterns to a substrate could not effectively be performed in the region of such other equipment without contaminating the latter. It thus was not possible in a single installation to provide an electrifiable material to a support which was imprinted with a color scheme, pattern or even legible matter. In practice, therefore, the adhesive was applied to the support, coated with the particulate material to form the relief pattern and only thereafter, following cleaning, was the support delivered to a printing machine.

OBJECTS OF THE INVENTION

It is the principal object of the present invention to alleviate the disadvantages enumerated above and to provide an improved apparatus for forming a patterned relief upon a substrate.

A more specific object of the invention is to provide a system which allows continuous imprinting and relief formation in the manner described upon a substrate in a single installation without detriment to the environment or danger to the equipment from undesirable dispersion of particulate materials.

Still another object of the invention is to provide a system for the purposes described which enables cleaning (removal of excess particles) without prior fixing of particles in the desired pattern to the adhesive.

It is also an object of the invention to provide a pattern-applying means which can be incorporated directly in a printing machine without danger that dispersed or stray particles will contaminate the printing mechanism or the imprinted product.

SUMMARY OF THE INVENTION

These objects and others which will become apparent hereinafter are attained in accordance with the present invention by the use of a vibratory sieve provided with an array of narrow vertical channels defined between electrically insulating bodies and having planar upper and lower surfaces, the bottom of which is formed with a conductive grill connected to an electrostatic voltage source, i.e. a direct current source at high voltage.

According to the invention, these channels are constituted by a series of electrically nonconductive cylindrical elements fixed in place but independent in a close-packed array with parallel axes and of the same or different diameters, which can be varied to determine the cross sections of the channels, disposed perpendicularly to the electrostatic grill of the grate and maintained in their desired positions solely by direct contact with neighboring elements or tubes along respective generatrices, this array of elements being surrounded or enclosed by a wall contacting the outer elements also along the generatrices thereof. This grate is associated with two complementary masks one of which is a cut-out conforming to the pattern to be applied to the substrate while the other is open all around the pattern but closed over the region coextensive with the pattern.

The first of these masks connected to a feeding funnel or hopper, deposits the particles only in the region of the uncovered cylindrical elements for movement through the channels to apply to the adhesive layer, which may also have the outlines of the pattern to be applied, thereby forming the particle-coated adhesive pattern. All other cylinders and the respective channels are covered during this operation.

The second mask is associated with a suction hood fitted over the grate for drawing particles from the previously covered channels while the second mask obstructs the channels through which the particles were originally applied. The apparatus of the present invention allows controlled application of flock, cut fiber and like particles and removal of any excess without danger that the removal operation will interfere with the application operation and thus without requiring any heat setting of the adhesive prior to the removal operation.

In practice, the channels of the sieve which are of lengths equal to the lengths of the cylindrical elements, are filled with the electrifiable material which does not have to be replenished in the tubes or channels because the latter constitute a reservoir containing the necessary amount of electrifiable material and can be emptied.

Naturally, the cylindrical elements can be replaced by others of greater or lesser diameter and length, also in a close-packed relationship, depending upon the pattern to be produced and the quantity of the electrifiable material which must be received in the unmasked channels between the tubes which are in contact along their generatrices.

In the next step, the channels previously filled with the electrifiable material and then emptied are covered by the second mask while suction is applied to all the other channels thereby drawing off any scattered or excess particles.

The advantages of the device of the present invention are numerous. Firstly, there is a significant saving in the electrifiable material which may be used since the losses re minimal.

When the voltage is applied, practically all of the particles are implanted in the adhesive in the pattern determined by the first mask and the amount of particles removed around the second mask is small. The device can operate even prior to full bonding of the implanted particles through the adhesive to the substrate. The aspiration is applied also in conjunction with an electrostatic charge upon the grill, thereby further eliminating any possibility of particle scattering or dispersion.

Since it is not necessary to utilize a fixing step for the adhesive before the cleaning operation is effected, it is possible to incorporate a device of the type described in a serigraphic printing installation, for instance, in one of the regions or stations at which articles are placed upon a conveyor or along a transport path. It is thus possible, in accordance with the invention, to apply a relief in the manner described and then, along the same transport path, to imprint the workpiece whereby both the applied relief and the imprinted pattern can be fixed simultaneously at a subsequent station.

It has been found to be advantageous, moreover, to provide the particle-deposition device side by side with an aspiration device provided with a complementary but second mask. A plurality of such deposition and aspirating devices can be provided in succession along the transport path when, for example, multi-color patterns are to be produced.

I have also found it to be advantageous, upstream of the deposition device, in the direction of displacement of the workpiece or substrate, to place a doctoring station in which a blade imparts uniformity to the adhesive layer and thereby conditions the latter to enable a uniform thickness to be obtained before the particles are imprinted thereon.

The doctoring head according to the invention comprises two scrapers which are movable in opposite directions and each inclined at an angle of about 70° to the plane of the substrate. One of these scrapers is composed of a material of about 70° Shore hardness and has a rounded end while the other scraper is composed of a material of about 60° Shore hardness and has a lower edge which is beveled.

The patterned or relief surfaces thus produced can be used as fabric appliques or to make cutouts to be stitched to garments or for the application of patterns to fabrics ultimately sewn into garments. The relief article, therefore, with its highly uniform adhesive coating and especially clean and sharp pattern afforded by the apparatus of the present invention thus also can be considered part of the invention.

BRIEF DESCRIPTION OF THE DRAWING

The above and other objects, features and advantages of the present invention will become more readily apparent from the following description, reference being made to the accompanying drawing in which.

SPECIFIC DESCRIPTION

Figure 1:
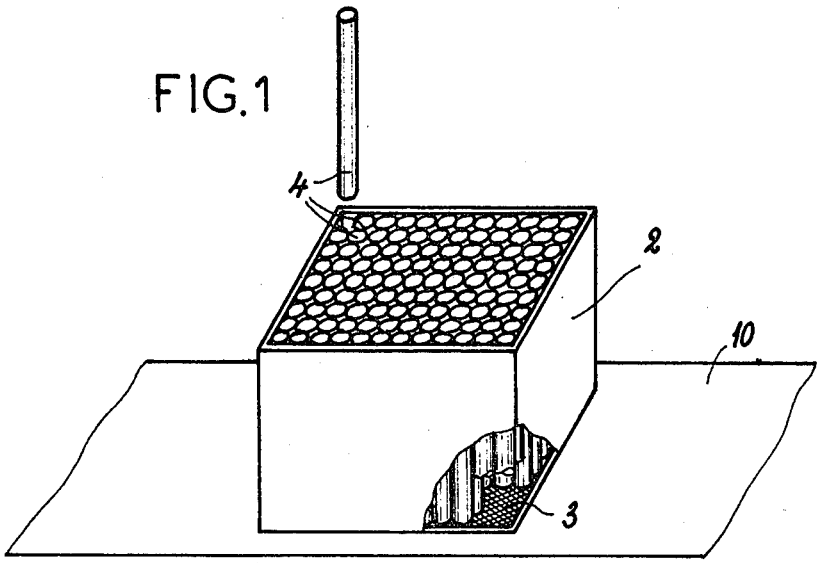
FIG. 1 is a highly diagrammatic partially exploded perspective view, partly broken away, illustrating a distribution sieve in accordance with the present invention.
Figure 2:
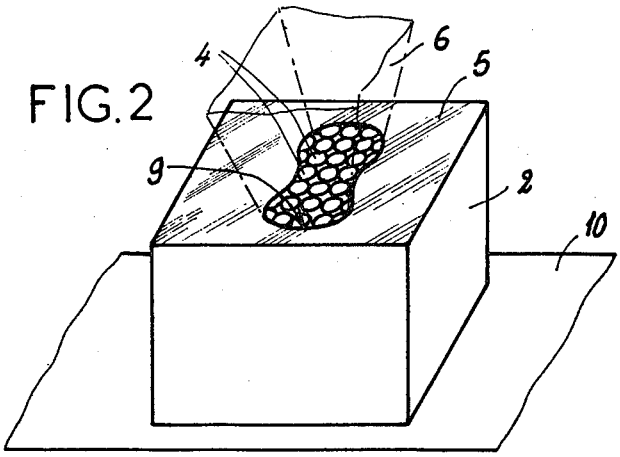
FIG. 2 is a perspective view illustrating the use of the device of FIG. 1 in its distribution mode.

FIGS. 1 through 2 show a vibratory distributor 2. As can be seen from FIG. 1 this distributor is formed at its underside with a conductive grill 3 and contains cylindrical elements 4. The device is adapted to receive either a feeding mask 5 (FIG. 2) or a cleaning mask 7 (FIG. 3) respectively connected with a feeding channel 6 (FIG. 2) and a suction hood 8 (FIG. 3) for use in the manner described below.

Figure 1A:
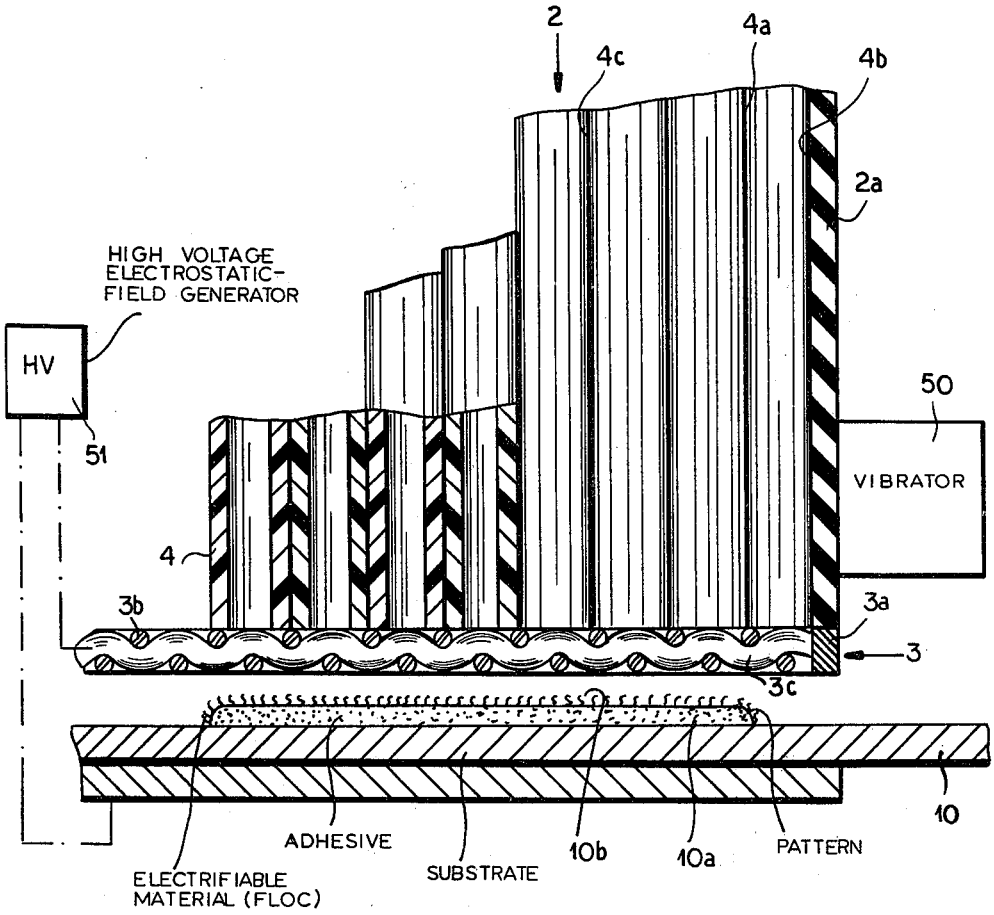
FIG. 1A is a diagrammatic cross section drawn to an enlarged scale showing further details of the device of the invention.

As can be seen from FIGS. 1 and 1A, the vibrating feeder 2 comprises an insulating frame having vertical walls 2*a* to which a vibrator 50 may be attached and is affixed at its bottom end to the grill 3 which is connected to one pole of high voltage electrostatic field generator 51.

In the interior of the frame 2*a* and having their lower ends resting on the grill 3, which is made up of crossing wires 3*b* and 3*c* anchored in the metal frame 3*a*, are the cylindrical elements 4 which are fixed during operation by tight packing but otherwise are removble or replaceable.

These cylindrical elements, which have parallel axes, are composed of an electrically nonconductive material such as polyvinylchloride.

All of the elements 4 shown in the drawing are of the same diameter although it should be apparent that they can be replaced by other tubes of different diameter and different length as required. Within the distributor, moreover, and depending upon the pattern, the diameters of the tubes may vary as well.

The cylindrical elements 4 are retained in position by contact with the neighboring elements along their generatrices 4*a* and by contact, likewise along their generatrices, with the walls of the frame 2*a* as represented by 4*b*. Between four neighboring elements, therefore, compartments 4*c* are formed which are filled with the particulate material which also fills the tubes.

As can be seen from FIG. 2, when the device of FIG. 1 is used to deliver the electrifiable material, a mask 5 is placed upon the upper portion of the tube array and covers all of the channels and cylindrical elements except in the region 9, which forms a cutout in the mask of the configuration of the pattern to be deposited. The channels are filled with the electrifiable material from a funnel 6 whose lower opening corresponds in shape to the cutout 9.

After the channels are filled, the electrostatic charge is applied to the grill 3 by the source 51 and vibrator 50 is actuated to posit the flock or other particulate material in a layer 10*b* on a previously applied adhesive coating 10*a* which is shown of an exaggerated thickness on the substrate 10 in FIG. 1A. Naturally, this adhesive will be impregnated into and of a similar thickness on the substrate 10.

To remove any excess particles (FIG. 3) the mask 5 is replaced by a mask 7 which is complementary, i.e. covers the zone formed by the cutout 9 and uncovering all of the other channels. The excess particles are withdrawn by the suction hood 8.

The support 10 is coated with the adhesive in the same pattern by any conventional method. During the application of particles the grill 3 is at a high voltage to effect projection of the electrifiable material contained in the cylindrical elements corresponding to the cutout 9 upon the adhesive coating of support 10. Thus the device limits the deposit of the particulate material to the regions of the pattern predominantly and eliminates any dispersion in the environment. The mask 7 prevents particles on the adhesive layer from being withdrawn even although the adhesive has not been set previously. Thus practically all of the material applied is implanted on the adhesive layer which remains sufficiently stable for imprinting the latter with a color pattern.

Figure 5:
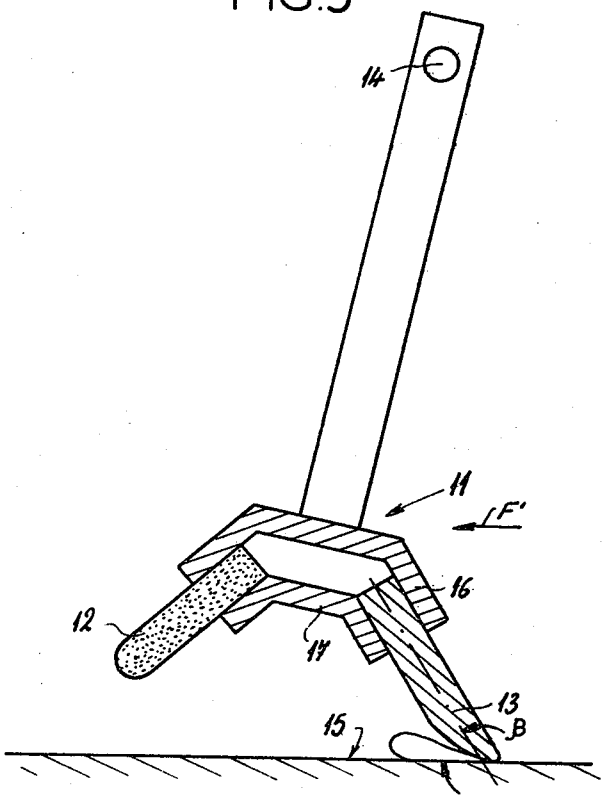
FIG. 5 is a similar view illustrating the leveling step.
Figure 4:
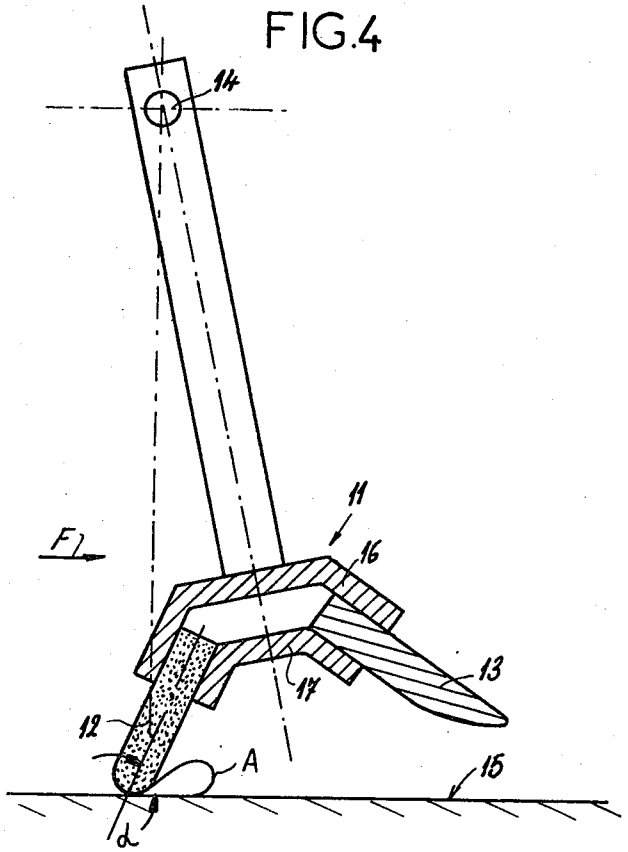
FIG. 4 is a vertical cross section through the doctoring head of the present invention showing the step in which the adhesive is impregnated into or applied to the substrate.

Since it is important to ensure that the layer of adhesive has a uniform thickness, I prefer to make use of the device shown in FIGS. 4 and 5 which illustrate a doctoring head for this purpose. In these FIGURES, the doctoring head is represented generally at 11 and comprises two blades or scrapers 12 and 13. The head is of the bistable or two-position rocker type, being mounted on a movable arm 14 connected to permit its transverse displacement in the plane of cutting back and forth with reversal of the position of the head at the end of each stroke.

The head 11 has generally the configuration of an inverted U, one of whose branches forms the first scraper 12 which is rounded at its lower end, is composed of rubber or of like material with a hardness of about 70° Shore while the other branch of the U is formed by the second scraper 12 with a beveled or feathering lower end and also composed of rubber or other material with a Shore hardness of about 60°.

The upper part of each of the scraper bars 12 and 13 is maintained between a pair of jaws 16 and 17 to ensure rigidity of the head.

The first pass of the device is represented by the arrow F in FIG. 4 and the bar 12 applies the adhesive A to the substrate surface 15 as shown, thereby impregnating the surface and forming a coating of the adhesive thereon. The bar 12 in this position includes an angle of about 70° with the surface 15.

On the return stroke, following rocking of the head as shown in FIG. 5, the scraper 13 is effective to distribute, doctor and level the adhesive layer, this bar also being oriented at an angle $\beta$ of about 70° to the surface 15. The heads move at a velocity relative to the surface between 0.15 and 0.60 m/sec.

Depending upon the nature of the support to be coated and the rheological properties of the adhesive, two to four passes may be used for maximum uniformity of thickness.

The layer of adhesive may be applied by a body (not shown) which is pivotal or rotatable about a horizontal axis and which can deposit the layer in a predetermined pattern in a conventional manner. The adhesive-applying means and the doctoring means can be synchronized mechanically and electrially with the other stations of a machine for printing the substrate utilizing, as the transport means through the machine, a turntable or endless belt. The doctoring means can be provided at any desired station, e.g. as a substitute for another station thereof. The doctoring head is pivoted to allow it to be swung away from the substrate when the adhesive leveling operation is complete.

The distribution device for localizing deposit of the particulate material utilized together with the doctoring head, enables the invention to be applied to a continuous apparatus for producing relief motifs with electrifiable material and their imprinting of coloration without the need for fixing the relief or an intermediate fixing step.

Figure 3:
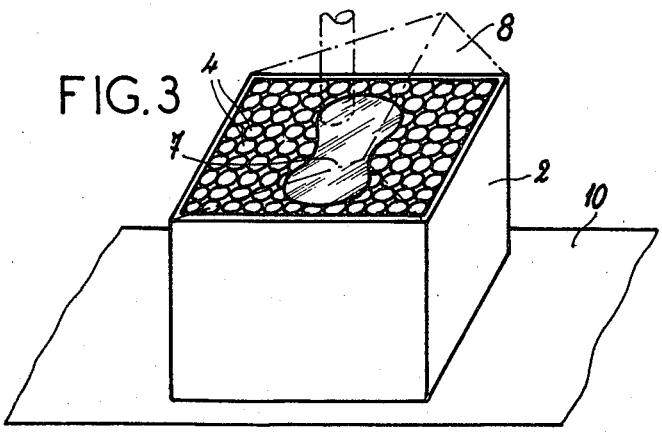
FIG. 3 is a similar view illustrating the use of the device in its cleaning mode.
Figure 6:
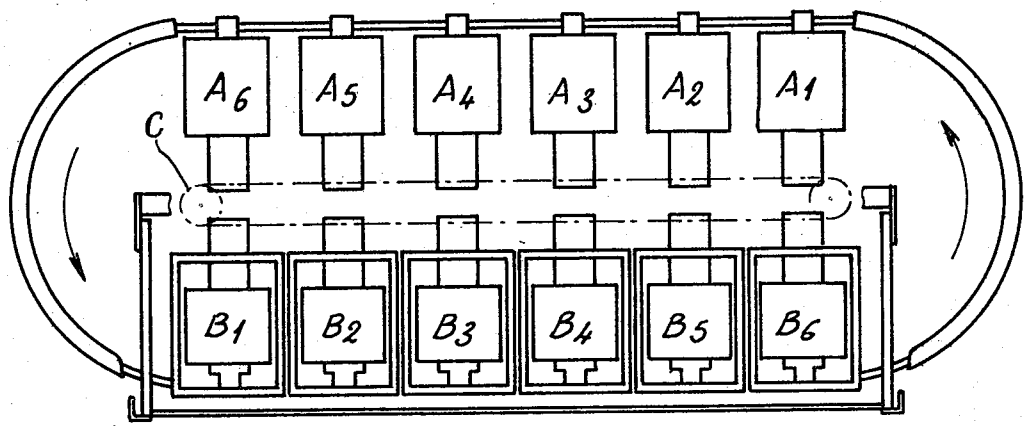
FIG. 6 is a highly diagrammatic plan view illustrating an installation for carrying out the invention.

It is therefore a feature of the invention that at least one of the stations ordinarily provided on a machine for silk screen printing can be replaced with devices corresponding to those of FIGS. 1 through 5 as described above. FIG. 6 shows a printing machine in highly schematic form which comprises six stations through which the articles to be printed are displaced, namely, the stations A1, A2, A3, A4, A5 and A6 as well as six printing heads at B1, B2, B3, B4, B5 and B6. Only the three first stations A1, A2 and A3 are used for positioning the articles on the continuous belt C while the next three stations A4, A5 and A6 are constituted respectively by a doctoring station provided with the head 11 for application and leveling of the adhesive in the desired pattern, a device for the localized deposition of the electrifiable material (FIG. 2), and a device for evacuating the excess (FIG. 3). The printing heads B1–B6 serve to print the successive colors of th design desired on the relief motif. The imprinted relief is then subjected to conventional fixing by thermal means to set the adhesive and the imprint thereon.

While any number of heads can be used in accordance with the present invention, and the specific head functions can be changed within the scope thereof, mention should be made of the possibility of substituting for the adhesive application head the imprinting with a colored material to which flock or cut fiber can bond.

I claim:

1. An apparatus for the application of electrifiable particles such as a flock and cut fibers, to an adhesive-coated substrate in accordance with a predetermined pattern, comprising:

a frame having vertical walls;

a conductive grill disposed on one side of said frame and juxtaposed with said substrate for electrostatically charging particles and promoting transfer thereof to said adhesive;

a multiplicity of elongated cylindrical elements in the form of individual tubes disposed in said frame and extending perpendicular to said substrate, said elements defining channels opening at said grill toward said substrate, said elements being in contact with one another along respective generatrices, at least some of said elements contacting said walls of said frames along generatrices of said elements;

a mask formed with an opening corresponding to said pattern and disposed on said elements at ends thereof remote from said grill to expose channels within the opening;

means for introducing said particles into said channels through said opening, said frame, said grill and said elements forming a distributor for said particles; and means for vibrating said distributor.

2. The apparatus defined in claim 1, further comprising means for removing excess particles from said substrate and including a frame and elongated nonconductive elements defining channels perpendicular to said substrate, a second mask in the shape of said opening and overlying the elements of the latter frame while exposing the channels around said second mask, and means for aspirating particles from said substrate through the latter channels.

3. The apparatus defined in claim 1 wherein said elements are replaceable within said frame.

* * * * *